US007519462B2

(12) United States Patent
Brown et al.

(10) Patent No.: US 7,519,462 B2
(45) Date of Patent: Apr. 14, 2009

(54) CROWD FORCE CONTROL IN ELECTRICALLY PROPELLED MACHINE

(75) Inventors: Bryan D. Brown, Peoria, IL (US); Sivaprasad Akasam, Peoria, IL (US); Rabie E. Khalil, Dunlap, IL (US); Brian D. Hoff, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 418 days.

(21) Appl. No.: 11/238,933

(22) Filed: Sep. 29, 2005

(65) Prior Publication Data

US 2007/0073465 A1 Mar. 29, 2007

(51) Int. Cl.
*B60L 11/00* (2006.01)
*G06F 19/00* (2006.01)

(52) U.S. Cl. ..... 701/50; 701/22; 414/699

(58) Field of Classification Search ..... None
See application file for complete search history.

(56) References Cited

U.S. PATENT DOCUMENTS 4,012,680 A * 3/1977 Dickerson et al. ..... 388/806
4,017,739 A 4/1977 Hapeman et al.
4,743,814 A * 5/1988 Sankey ..... 318/140
4,776,751 A 10/1988 Saele
5,968,103 A 10/1999 Rocke
2004/0117092 A1 6/2004 Budde
2005/0278100 A1 * 12/2005 Porter ..... 701/50

FOREIGN PATENT DOCUMENTS

EP 1484274 12/2004

* cited by examiner

*Primary Examiner*—Michael J. Zanelli
(74) *Attorney, Agent, or Firm*—Liell & McNeil

(57) ABSTRACT

A method of operating an electrically propelled machine includes the steps of, operating an electrical power source for the machine, and limiting an output torque of an electrical propulsion motor system of the machine based upon the occurrence of a crowd force condition of the machine. An electrically propelled machine is further provided, including an electronic controller having means for limiting motor output torque based at least in part on a crowd force condition of the machine.

20 Claims, 3 Drawing Sheets

CROWD FORCE CONTROL IN ELECTRICALLY PROPELLED MACHINE

STATEMENT OF GOVERNMENT INTEREST

The United States Government has certain rights in the present patent application, and any patent that may issue thereon, under DOE Contract No. FC36-01GO11095.

TECHNICAL FIELD

The present disclosure relates generally to electrically propelled work machines, and relates more particularly to a method of limiting crowd force in an electrically propelled work machine.

BACKGROUND

Electrically propelled work machines have been known in one form or another for many years. The continued depletion of fossil fuel reserves, coupled with increasing concerns about certain emissions from internal combustion engines, however, has motivated industry to adopt an increasing number of electrically propelled work machines. Interest in electrical propulsion systems for heavy equipment, in particular, has increased in recent years. In addition to the environmental and economic reasons for the rise in electrically propelled work machines, industry has begun to deliver better and more practical electrical generation and propulsion technologies to the marketplace.

With the advent of superior electrical propulsion system technologies have come new problems. One challenge in particular relates to the interaction of certain electrically propelled work machines with a work material, especially a work material pile. Over many years of experience with traditional work machine designs and operating systems, operators have come to expect certain performance and operating characteristics in particular types of work machines. For example, loader operators who have been trained on loaders having conventional hydraulic or partially hydraulic drive trains, have come to expect certain operating phenomena when loading material from a material pile.

One typical loading operation consists of an operator driving a loader into a material pile, to fill or partially fill the front-end bucket with work material. Once the loader has been driven into the pile, the operator may tilt the bucket back and upward, to lift the work material into the bucket. The operator can then reverse the work machine, and drive the loader with its bucket contents to a dumping site or truck. Substantially simultaneous with driving the loader into the pile, the operator may begin activating the bucket hydraulics. Activation of the bucket hydraulics will place a demand on the hydraulic system pump, in effect drawing power from the loader's internal combustion engine and reducing engine speed. Because of the drag on the engine, the forward power applied to the loader's wheels, known in the art as rim pull, will decrease. Thus, use of the work machine hydraulics will limit the degree to which the bucket is forced into the pile by the work machine's propulsion system.

In electrically propelled work machines, there is no such inherent limitation on the forward propulsion force from the electrical propulsion system. Accordingly, continued forward propulsion of the loader can force the bucket into the pile to such a point that it becomes jammed. The operator may then have difficulty in either lifting the bucket with its contents from the pile, or even backing the work machine out of the pile. The interaction between the work material pile and the hydraulically actuated bucket of the work machine, and the associated hydraulics, is known in the art as "crowd force."

U.S. Pat. No. 4,776,751 to Saele sets forth one system for controlling crowd force in a hydraulically driven loader. Saele includes a variable displacement hydraulic pump, and a fixed displacement hydraulic motor. Saele utilizes plural hydraulic pressure sensing switches to determine excessive crowd force on the work implement. Upon detecting excessive crowd force, an electronic controller overrides the operator's commands, and decreases fluid output of the hydraulic driving pump. Adjustment of the driving pump will decrease the fluid supply rate/pressure to the hydraulic motor, in turn limiting the forward driving force of the work machine. Saele thus appears to provide one workable approach to crowd control, albeit only for a specific type of loader.

The present disclosure is directed to overcoming one or more of the problems or shortcomings set forth above.

SUMMARY OF THE DISCLOSURE

In one aspect, the present disclosure provides a method of operating an electrically propelled work machine. The method includes the step of, operating an electrical power source of the work machine to supply electrical power to an electric propulsion motor of the work machine. The method further includes the step of limiting output torque of the electric propulsion motor based upon the occurrence of a crowd force condition of the work machine.

In another aspect, the present disclosure provides an electrically propelled work machine. The work machine includes an electrical power source, and an electrical propulsion system coupled with the electrical power source that includes an electric propulsion motor. An electronic controller is in control communication with the electric motor, and includes means for limiting an output torque of the electric propulsion motor based at least in part on a crowd force condition of the work machine.

In still another aspect, the present disclosure provides an electronic controller including means for limiting crowd force in an electrically propelled work machine at least in part by limiting output torque of an electric propulsion motor of the work machine where a crowd force acting on a work implement of the work machine exceeds a crowd force limit.

DETAILED DESCRIPTION

Figure 1:
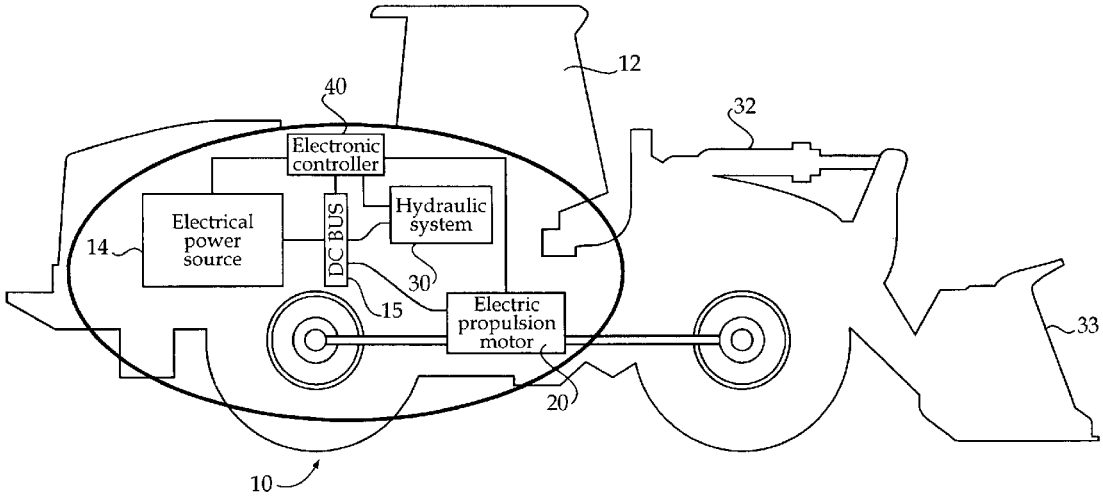
FIG. 1 is a diagrammatic side view of an electrically propelled work machine according to the present disclosure.

Referring to FIG. 1, there is shown an electrically propelled work machine 10, including a work machine body 12. Work machine 10 is illustrated in the context of a wheel loader, including a hydraulic work implement system 30 having a conventional hydraulic actuator 32 operable to move a work implement such as a bucket 33. It should be appreciated, however, that work machine 10 is not limited to a wheel loader at all and other loader types such as a track type loader might be constructed according to the present disclosure. Further, virtually any electrically propelled work machine including an end mounted, hydraulically actuated work implement may benefit from the teachings of the present disclosure, and many different work machine types may therefore be within its scope. Work machine 10 may further include an electrical power source 14, such as a generator, a fuel cell, a capacitor or a battery and an electric propulsion motor 20. An electronic controller 40 is provided for monitoring and controlling various aspects of work machine operation.

Figure 2:
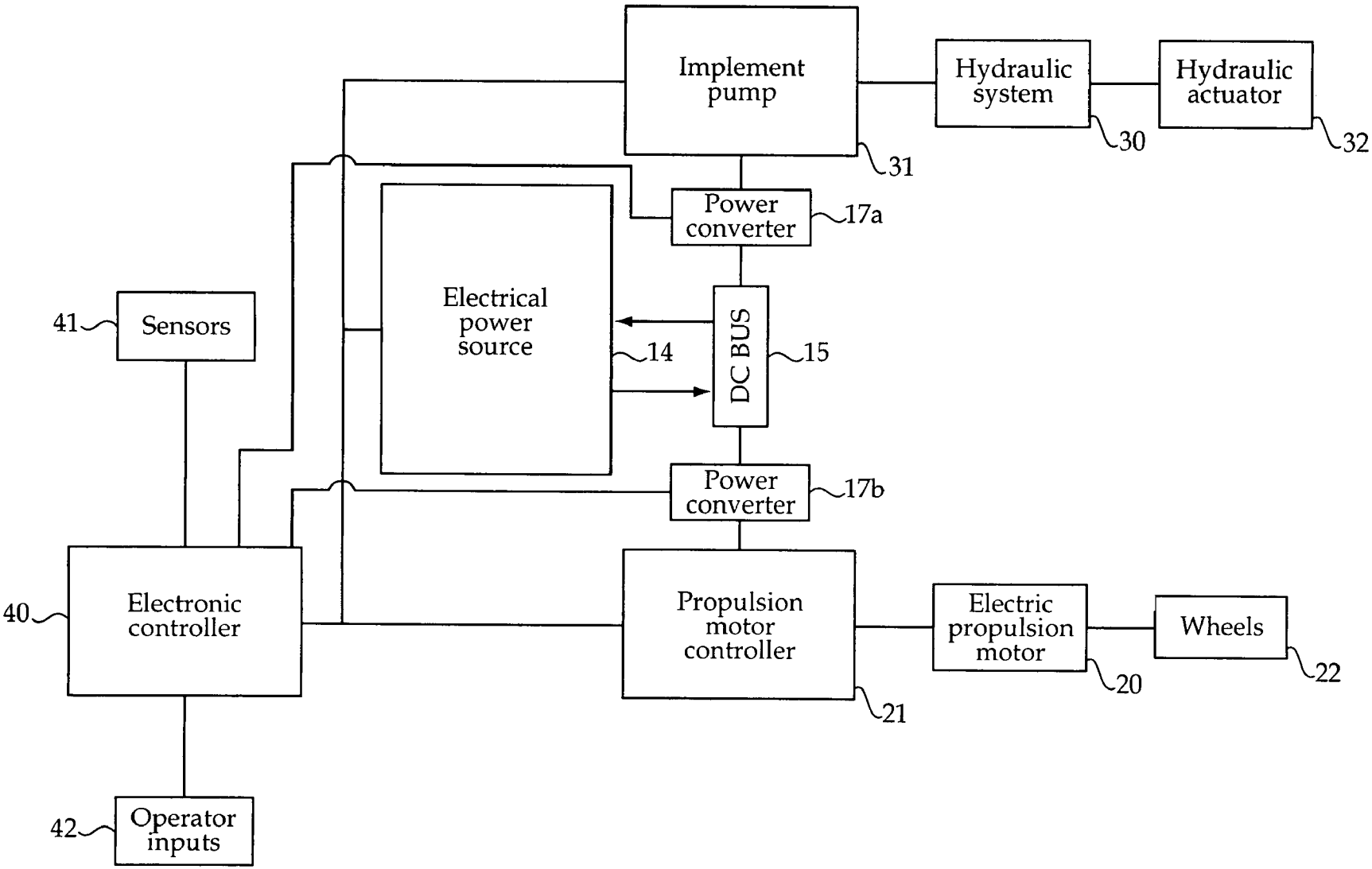
FIG. 2 is a block diagram illustrating a portion of the electrically propelled work machine of FIG. 1.

Referring also now to FIG. 2, there is shown a block diagram of certain of the components of work machine 10 shown in FIG. 1. Electrical power source 14 is shown in FIG. 2, a propulsion motor controller 21, and an implement pump controller 31. Each of controllers 21 and 31 may in turn be coupled with a supervisory electronic controller 40. Propulsion motor controller 21 may be coupled with propulsion motor 20, which is in turn coupled with the work machine wheels/tires 22. Implement pump controller 31 may be coupled with hydraulic system 30, which is in turn coupled with hydraulic actuator 32. Box 41 of FIG. 2 represents various sensors operable to communicate selected operating parameters to supervisory controller 40, for example ground speed, hydraulic pressure in system 30, bucket or actuator position, bus voltage, etc. Box 42 represents various operator inputs, such as from a throttle, brake pedals, steering wheel, etc.

Electrical power source 14 may also be coupled with a DC bus 15. DC bus 15 may in turn be coupled with implement pump controller 31 and with propulsion motor controller 21. In one contemplated embodiment, each of propulsion motor 20 and hydraulic system 30, including an implement pump, will be electrically powered. It is contemplated that in other embodiments the implement pump (not shown) may be mechanically powered, for example, via a coupling with an engine of the work machine. A first power converter 17*a* may be disposed between DC bus 15 and implement pump controller 31, whereas another power converter 17*b* may be disposed between DC bus 15 and propulsion motor controller 21. Each of power converters 17*a* and 17*b* may be controlled via supervisory controller 40, or either of controllers 21 and 31 to provide electrical power via a desired wave form to propulsion motor 20, or the implement pump of hydraulic system 30, respectively. In a typical embodiment, electrical power source 14 will be operated to maintain a DC bus voltage within some predetermined range, which may be a relatively narrow range. In such an embodiment, DC bus voltage may be controlled on the basis of factors other than output torque of motor 20. In other contemplated embodiments, however, bus voltage may vary substantially, such as where certain components of work machine 10 temporarily draw electrical power from DC bus 15, and cause a reduction in the DC bus voltage.

The present disclosure further includes a method of operating an electrically propelled work machine such as work machine 10. The method includes the step of operating electrical power source 14 of work machine 10 to supply electrical power to electric propulsion motor 20. As described herein, electrical power source 14 of work machine 10 may be any of a fuel cell, a battery, a capacitor and a generator such as a conventional genset that includes an engine. In the context of work machine 10, the operating step may further include operating electrical power source 14 to control the voltage of DC bus 15. In certain embodiments, the operating step may further include controlling the DC bus voltage based on factors other than motor output torque during a crowd force condition. In other words, in certain embodiments bus voltage may be maintained at a given level or within a given range, irrespective of output torque of motor 20 when work machine 10 is interacting with a work material or otherwise experiencing a crowd force condition, such as where it is determined that hydraulic system 30 is in use as described herein.

The method may further include the step of limiting output torque of electric propulsion motor 20 based upon the occurrence of a crowd force condition of the work machine. A crowd force "condition" may be a crowd force acting on work implement 33 that is greater than a predetermined crowd force limit, for example. Alternatively, a crowd force condition may be a specific determination that work implement 33 is interacting with a work material pile, or that hydraulic system 30 is implementing a digging operation, for example, by determining that hydraulic system 30 is in use. In either case, detecting digging, or detecting crowd force above a threshold, output torque of motor 20 may be limited to prevent excessive crowd force and jamming of bucket 33 in a work material pile or overloading hydraulic system 30, as described herein.

The limiting step may further include the step of commanding an output torque of electric propulsion motor 20. In particular, supervisory controller 40, or propulsion motor controller 21 may command an output torque of motor 20 that limits electrical power draw of motor 20 from DC bus 15. The command may comprise a torque command to motor 20 such that it draws a particular current and/or voltage from DC bus 15. The command may also comprise, instead of or in addition to a torque command to propulsion motor 20, a command to power converter 17*b* to provide the desired electrical power wave form to propulsion motor 20 from DC bus 15.

The limiting step may further include commanding a reduced output torque, via either of the means described above, to motor 20 upon the occurrence of a crowd force acting on work implement 33 of work machine 10 that exceeds a crowd force limit. The crowd force limit may be an actively determined limit, or it may be a predetermined crowd force limit corresponding to a hydraulic pressure in hydraulic system 30 of work machine 10, for example. In one contemplated embodiment, output torque in motor 20 may be commanded via a crowd force map. For example, crowd force may be mapped to particular motor output torque levels such that for a given crowd force, a particular motor torque or maximum motor torque limit may be determined.

The limiting step may further comprise overriding an operator commanded motor output torque, where a crowd force condition is determined in work machine 10, or a crowd force above a predetermined limit. In the former instance, merely detecting that the work machine hydraulic system 30 is in use may signify a condition wherein the operator's inputs are always overridden by one of supervisory controller 40 and motor controller 21. In the latter case, one of the respective electronic controllers may determine if the operator is commanding a motor output torque that is above a predetermined motor output torque limit, and override the operator input only in such situations. These output torque limits may be determined via experimentation, modeling, or any other suitable method known in the art.

To effect a control process according to the present disclosure, electronic controller 40 may include a computer readable medium having a crowd force control algorithm recorded thereon. The control algorithm may include means for limiting output torque of electric motor 20 based at least in part on a crowd force condition of work machine 10. In a related vein, the control algorithm may include means for determining a value indicative of a crowd force acting on bucket 33.

The means for limiting may still further include means for limiting at least one of an electrical current and a voltage at motor 20 by generating a torque command to electric motor 20. The means for limiting may still further include means for, if a determined or predicted crowd force acting on bucket 33 exceeds the crowd force limit of work machine 10, commanding an output torque of electric motor 20 that is the lessor of, an output torque limit and an operator commanded output torque. The control algorithm may override the operator's commanded output torque where determined crowd force is above a predetermined limit. The control algorithm may only be activated when the controller determines that the work machine is in a digging state, if desired.

Those skilled in the art will appreciate that software control logic executed via an appropriate processor is but one means for carrying out a control process according to the present disclosure. For instance, dedicated hardware that emulates the control algorithm might alternatively be used to effect one or more of the steps of the presently described operating method.

INDUSTRIAL APPLICABILITY

A typical loader operating cycle will include repeated loading and unloading of bucket 33. An operator may drive work machine 10 into a pile of gravel, soil, debris, sawdust, etc., actuate bucket 33 via hydraulic cylinder 32, back out of the pile, then drive the loaded work material to a dump site or truck. Forward momentum of work machine 10, and forward rim pull via output torque from electric motor 20 may in some instances result in a crowd force between the material pile and bucket 33 that exceeds a crowd force limit of work machine 10. Excessive crowd force may cause bucket 33 to become stuck in the work material pile, as described herein. In other instances, excessive crowd force may present a risk of failure of one or more of the components of hydraulic system 30, for instance collapsing hydraulic cylinder 32 due to excessive pressure. In other words, the crowd force limit may be a function of the maximum hydraulic pressure that the respective hydraulic components of work machine 10 can accommodate. Where excessive crowd force is acting on bucket 33, or any time hydraulic system 30 is in use, the control process according to the present disclosure may be implemented to limit output torque of propulsion motor 20.

Figure 3:
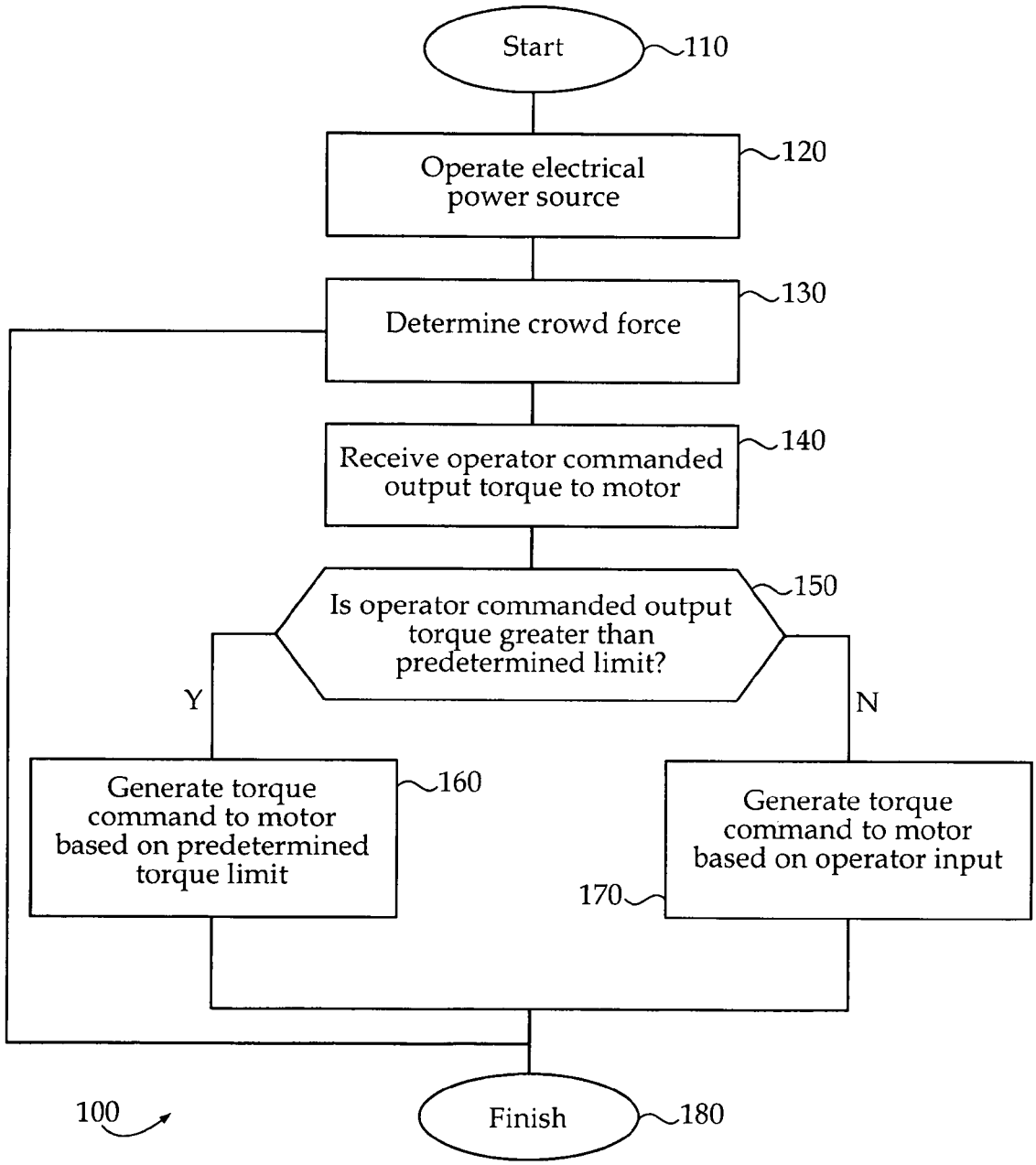
FIG. 3 is a flow chart illustrating an exemplary control process according to the present disclosure.

Referring to FIG. 3, there is shown an exemplary control process according to the present disclosure by way of a flowchart 100. The process of flowchart 100 will begin at a START, Box 110. From Box 110, the process may proceed to Box 120, which includes the step of operating electrical power source 14 to supply electrical power to propulsion motor 20. From Box 120, the process may proceed to Box 130, wherein electronic controller 40 may determine a crowd force condition of work machine 10. Determination of the crowd force may consist of either an actual measurement of the crowd force, for example via hydraulic pressure in hydraulic cylinder 32, or by otherwise inferring or estimating that crowd force exceeds a crowd force limit of work machine 10. Further still, as described herein determination of the crowd force condition at box 130 may simply include some indication that a digging operation is occurring, for example, an indication that the hydraulically actuated implements are in use. From Box 130, the process may proceed to Box 140, wherein supervisory controller 40, for example, will receive an operator commanded motor output torque. The operator input may consist of an electronic signal generated, for example, by a conventional throttle level or accelerator pedal, or a forward displacement of a hand controlled joystick. From Box 140, the process may proceed to Box 150, wherein electronic controller 40 may query whether the operator commanded output torque is greater than a predetermined limit.

As described herein, the commanded output torque, whether it be by the operator or supervisory controller 40, may be a commanded current or voltage to electric motor 20 that corresponds to a desired torque. The output torque command may also be communicated to power converter 17*b*, such that it provides electrical power via the desired wave form to electric motor 20. From Box 150, if the operator commanded output torque is determined to be greater than the predetermined limit, the process may proceed to Box 160, wherein electronic controller 40 may generate an output torque command to motor 20 that is based on the predetermined limit. If at Box 150 the operator commanded output torque is not greater than the predetermined limit, the process may proceed to Box 170 wherein supervisory controller 40 may generate an output torque command to motor 20 that is based on the operator input, or operator commanded output torque. From either of Boxes 160 or 170, the process may proceed directly to Box 180, a FINISH, if work machine 10 is no longer performing a digging operation. If crowd force control is still necessary, such as where work machine 10 continues to be commanded to bear against a material pile, the process may return to Box 130, to repeat the foregoing steps.

The present disclosure thus provides a crowd force control method whereby the propulsion of work machine 10 is reduced where a determined excessive crowd force or predicted risk of excessive crowd force is made. Reducing output torque of motor 20 will reduce rim pull via the wheels of work machine 10, and lessen the likelihood of jamming work machine 10 in the work material pile or collapsing the system hydraulics. The presently described approach provides various advantages over known designs, in particular by providing a reduction in propulsion without necessarily requiring a reduction in the output of electrical power source 14. Those skilled in the art will appreciate that in certain operating environments, such as underground mines, emissions and fuel economy concerns may make it desirable to avoid rapidly increasing or decreasing the speed/load of a work machine generator. The present disclosure reduces the need for such changes in engine speed and load by actively commanding output torque of motor 20 rather than controlling the power output of electrical power source 14.

The present description is for illustrative purposes only, and should not be construed to narrow the breadth of the present disclosure in any fashion. Thus, those skilled in the art will appreciate the various modifications might be made to the presently disclosed embodiments without departing from the intended spirit and scope of the present disclosure. Other aspects, features and advantages will be apparent upon an examination of the attached drawing Figures and appended claims.

What is claimed is:

1. A method of operating an electrically propelled machine comprising the steps of:

operating an electrical power source of the machine to supply electrical power to an electric propulsion motor of the machine;

limiting output torque of the electric propulsion motor based upon the occurrence of a crowd force condition of the machine; and inhibiting changing a power output of the electrical power source, during the limiting step.

2. The method of claim 1 wherein the limiting step comprises the step of commanding an output torque of the electric propulsion motor.

3. The method of claim 2 wherein the operating step comprises controlling a voltage of a DC bus of the machine coupled with the electric propulsion motor.

4. The method of claim 3 wherein the limiting step comprises commanding a reduced output torque of the electric propulsion motor upon the occurrence of a crowd force acting on a hydraulically actuated work implement of the machine that exceeds a crowd force limit.

5. The method of claim 4 wherein the limiting step comprises commanding the reduced output torque where a determined crowd force acting on a loader bucket of the machine exceeds a predetermined crowd force limit.

6. The method of claim 5 further comprising the step of determining the occurrence of a crowd force condition of the machine via an electronic controller coupled with a hydraulic system of the machine, wherein the limiting step comprises commanding an output torque of the electric propulsion motor at or below an output torque limit for the electric propulsion motor.

7. The method of claim 6 wherein the operating step comprising supplying electrical power to the electric propulsion motor from at least one of, a fuel cell, a battery, a capacitor and a generator.

8. A method of operating an electrically propelled machine comprising the steps of:

operating an electrical power source of the machine to supply electrical power to an electric propulsion motor of the machine; and limiting output torque of the electric propulsion motor based upon the occurrence of a crowd force condition of the machine;

wherein the limiting step comprises the step of commanding an output torque of the electric propulsion motor;

wherein the operating step comprises controlling a voltage of a DC bus of the machine coupled with the electric propulsion motor;

wherein the limiting step comprises commanding a reduced output torque of the electric propulsion motor upon the occurrence of a crowd force acting on a hydraulically actuated work implement of the machine that exceeds a crowd force limit;

wherein the limiting step comprises commanding the reduced output torque where a determined crowd force acting on a loader bucket of the machine exceeds a predetermined crowd force limit; and wherein the limiting step comprises commanding the reduced output torque of the electric propulsion motor via an electronic controller and based at least in part on a crowd force map.

9. A method of operating an electrically propelled machine comprising the steps of:

operating an electrical power source of the machine to supply electrical power to an electric propulsion motor of the machine; and limiting output torque of the electric propulsion motor based upon the occurrence of a crowd force condition of the machine;

wherein the limiting step comprises the step of commanding an output torque of the electric propulsion motor;

wherein the operating step comprises controlling a voltage of a DC bus of the machine coupled with the electric propulsion motor;

wherein the limiting step comprises commanding a reduced output torque of the electric propulsion motor upon the occurrence of a crowd force acting on a hydraulically actuated work implement of the machine that exceeds a crowd force limit;

wherein the limiting step further comprises commanding the reduced output torque where a determined crowd force acting on a loader bucket of the machine exceeds a predetermined crowd force limit;

the method further comprising the step of determining the occurrence of a crowd force condition of the machine via an electronic controller coupled with a hydraulic system of the machine, wherein the limiting step comprises commanding an output torque of the electric propulsion motor at or below an output torque limit for the electric propulsion motor;

wherein the operating step comprising supplying electrical power to the electric propulsion motor from at least one of, a fuel cell, a battery, a capacitor and a generator; and wherein the limiting step further comprises:

if a determined crowd force acting on the loader bucket of the machine is below the crowd force limit of the machine, generating a motor output torque command according to an operator input; and if the determined crowd force acting on the loader bucket of the machine is equal to or above the crowd force limit, generating a motor output torque command that is the lesser of a predetermined motor torque limit and an operator input.

10. The method of claim 9 wherein the operating step further comprises controlling the DC bus voltage based on factors other than the motor output torque during a crowd force condition.

11. An electrically propelled machine comprising:

an electrical power source;

an electrical propulsion system coupled with said electrical power source and including an electric propulsion motor; and an electronic controller in control communication with said electric motor, said electronic controller including means for limiting an output torque of said electric propulsion motor and for inhibiting changing a power output of said electrical power source during limiting the output torque, based at least in part on a crowd force condition of said machine.

12. The electrically propelled machine of claim 11 further comprising:

a hydraulic work implement system including a hydraulically actuated work implement; and means for determining a value indicative of a crowd force acting on said work implement;

wherein said means for limiting output torque of said electric propulsion motor includes means for limiting at least one of an electrical current and a voltage at said electric propulsion motor, based at least in part on the determined value.

13. The electrically propelled machine of claim 12 further comprising a DC bus, said electrical power source including at least one of, a fuel cell, a generator, a capacitor and a battery coupled with said DC bus.

14. The electrically propelled machine of claim 13 wherein said means for limiting an output torque of said electric propulsion motor comprises means for commanding an output torque of said electric propulsion motor that is the lesser of an operator commanded output torque and an output torque limit.

15. The electrically propelled machine of claim 14 wherein said means for limiting comprises means for commanding an output torque of said electric propulsion motor that is the lesser of an operator commanded output torque and an output torque limit, if the determined value indicative of crowd force is above a predetermined threshold.

16. The electrically propelled machine of claim 13 wherein said means for limiting output torque of said electric propulsion motor includes a power converter disposed between said DC bus and said electric propulsion motor, said electronic controller being in control communication with said power converter.

17. The electrically propelled machine of claim 16 wherein said electronic controller comprises means for varying an output of said power converter to said electric propulsion motor, based at least in part on a crowd force condition of said machine.

18. The electrically propelled machine of claim 13 further comprising means for controlling a voltage of said DC bus based on factors other than motor output torque during a crowd force condition of said machine.

19. An electronic controller for an electrically propelled machine having an electrical power source, an electric propulsion motor and a power converter coupled between the electrical power source and the electric propulsion motor, the electronic controller comprising means, including control command generating means, for limiting crowd force in the electrically propelled machine at least in part by limiting output torque of the electric propulsion motor of said machine and for inhibiting changing a power output of said electrical power source during limiting the output torque, via control commands to at least one of the electric propulsion motor and the power converter where a crowd force acting on a work implement of said machine exceeds a crowd force limit.

20. The electronic controller of claim 19 wherein said means for limiting crowd force in the electrically propelled machine comprises means for commanding at least one of, a reduced electrical current and a reduced voltage to said electric propulsion motor.

* * * * *

US007519462C1

(12) EX PARTE REEXAMINATION CERTIFICATE (9548th)

United States Patent
Brown et al.

(10) Number: US 7,519,462 C1
(45) Certificate Issued: Mar. 6, 2013

(54) CROWD FORCE CONTROL IN ELECTRICALLY PROPELLED MACHINE

(75) Inventors: Bryan D. Brown, Peoria, IL (US); Sivaprasad Akasam, Peoria, IL (US); Rabie E. Khalil, Dunlap, IL (US); Brian D. Hoff, East Peoria, IL (US)

(73) Assignee: United States Department of Energy, Washington, DC (US)

Reexamination Request:
No. 90/009,884, Apr. 26, 2011

Reexamination Certificate for:

| | |
|---|---|
| Patent No.: | **7,519,462** |
| Issued: | **Apr. 14, 2009** |
| Appl. No.: | **11/238,933** |
| Filed: | **Sep. 29, 2005** |

(51) Int. Cl.
*B60L 11/00* (2006.01)
*G06F 19/00* (2006.01)

(52) U.S. Cl. ..... 701/50; 701/22; 414/699

(58) Field of Classification Search ..... 701/50
See application file for complete search history.

(56) References Cited

To view the complete listing of prior art documents cited during the proceeding for Reexamination Control Number 90/009,884, please refer to the USPTO's public Patent Application Information Retrieval (PAIR) system under the Display References tab.

*Primary Examiner* — Cary Wehner

(57) ABSTRACT

A method of operating an electrically propelled machine includes the steps of, operating an electrical power source for the machine, and limiting an output torque of an electrical propulsion motor system of the machine based upon the occurrence of a crowd force condition of the machine. An electrically propelled machine is further provided, including an electronic controller having means for limiting motor output torque based at least in part on a crowd force condition of the machine.

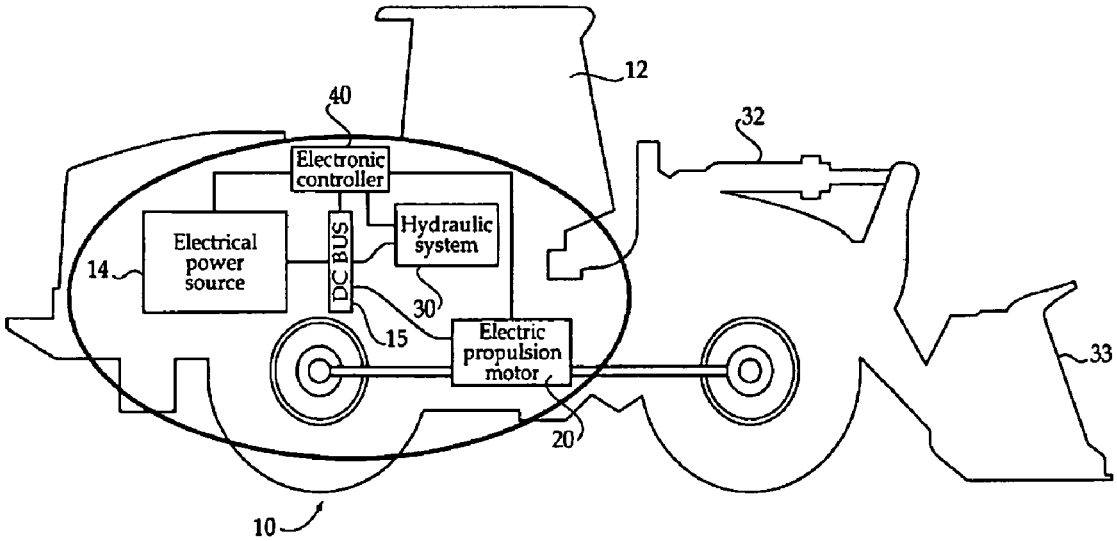

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-7, 11, 14, 15, 17, 19 and 20 are determined to be patentable as amended.

Claims 12, 13, 16 and 18, dependent on an amended claim, are determined to be patentable.

New claims 21-33 are added and determined to be patentable.

Claims 8-10 were not reexamined.

1. A method of operating an electrically propelled machine comprising the steps of:

operating an electrical power source of the machine to supply electrical power to an electric propulsion motor of the machine;

*detecting an occurrence of a crowd force condition of the machine;* limiting output torque of the electric propulsion motor, based upon the *detected* occurrence of a crowd force condition of the machine[;]*, by providing a command to the electric propulsion motor,* and [inhibiting changing] *without controlling the electrical power source to change* a power output of the electrical power source[, during] *as part of* the limiting step.

2. The method of claim 1 wherein *the command is an output torque command, and* the limiting step comprises the step of [commanding] *sending the output torque command to command* an output torque of the electric propulsion motor.

3. The method of claim [2] *1* wherein the operating step comprises controlling a voltage of a DC bus of the machine coupled with the electric propulsion motor.

4. The method of claim 3 wherein the limiting step comprises [commanding] *providing the command to the electric propulsion motor to command* a reduced output torque of the electric propulsion motor upon the occurrence of a crowd force acting on a hydraulically actuated work implement of the machine that exceeds a crowd force limit.

5. The method of claim 4 wherein the limiting step comprises [commanding] *providing the command to the electric propulsion motor to command* the reduced output torque where a determined crowd force acting on a loader bucket of the machine exceeds a predetermined crowd force limit.

6. The method of claim 5 further comprising the step of determining the occurrence of a crowd force condition of the machine via an electronic controller coupled with a hydraulic system of the machine, wherein the limiting step comprises [commanding] *providing the command to the electric propulsion motor to command* an output torque of the electric propulsion motor at or below an output torque limit for the electric propulsion motor.

7. The method of claim 6 wherein the operating step comprising supplying electrical power to the electric propulsion motor from at least one of[.] a fuel cell, a battery, a capacitor and a generator.

11. An electrically propelled machine comprising:

an electrical power source;

an electrical propulsion system coupled with said electrical power source and including an electric propulsion motor; and an electronic controller in control communication with said electric motor, said electronic controller including means for

*detecting a crowd force condition of the machine;* limiting an output torque of said electric propulsion motor, *based at least in part on the detected crowd force condition of the machine, by providing a command to the electric propulsion motor,* and [for inhibiting changing] *without controlling the electrical power source to change* a power output of said electrical power source [during] *as part of* limiting the output torque[, based at least in part on a crowd force condition of said machine].

14. The electrically propelled machine of claim 13 wherein said means for limiting an output torque of said electric propulsion motor comprises means for [commanding] *providing the command to the electric propulsion motor to command* an output torque of said electric propulsion motor that is the lesser of an operator commanded output torque and an output torque limit.

15. The electrically propelled machine of claim 14 wherein said means for limiting comprises means for [commanding] *providing the command to the electric propulsion motor to command* an output torque of said electric propulsion motor that is the lesser of an operator commanded output torque and an output torque limit, if the determined value indicative of crowd force is above a predetermined threshold.

17. The electrically propelled machine of claim 16 wherein said electronic controller comprises means for [varying] *providing the command to the power converter to vary* an output of said power converter to said electric propulsion motor, based at least in part on [a] *the detected* crowd force condition of said machine.

19. An electronic controller for an electrically propelled machine [having]*, comprising:* an electrical power source, an electric propulsion motor, and a power converter coupled between the electrical power source and the electric propulsion motor, the electronic controller comprising means, including*:*

*detecting means for detecting a crowd force acting on a work implement of the electrically propelled machine;*

*determining means for determining whether the crowd force acting on the work implement exceeds a crowd force limit;* control command generating means[,] for limiting*, in response to determining that the* crowd force [in the electrically propelled machine] *acting on the work implement exceeds the crowd force limit, the crowd force acting on the work implement* at least in part by [limiting] *providing control commands to at least one of the electric propulsion motor or the power converter to limit* output torque of the electric propulsion motor of said machine, and [for inhibiting changing] *without controlling the electrical power source to change* a power output of said electrical power source [during] *as part of* limiting the output torque[, via control commands to at least one of the electric propulsion motor and the power converter where a crowd force acting on a work implement of said machine exceeds a crowd force limit].

20. The electronic controller of claim 19 wherein said means for limiting crowd force in the electrically propelled machine comprises means for commanding at least one of[,] a reduced electrical current and a reduced voltage to said electric propulsion motor.

*21. The method of claim 1, wherein detecting an occurrence of a crowd force condition of the machine includes at least one of:*

*determining that a hydraulic pressure in a hydraulic system that actuates a work implement of the electrically propelled machine exceeds a threshold;*

*determining that a digging operation of the electrically propelled machine is occurring; or*

*determining that the work implement is in use.*

*22. The electrically propelled machine of claim 11, wherein, to detect a crowd force condition of the machine, the electronic controller includes means for at least one of:*

*determining that a hydraulic pressure in a hydraulic system that actuates a work implement of the electrically propelled machine exceeds a threshold;*

*determining that a digging operation of the electrically propelled machine is occurring; or*

*determining that the work implement is in use.*

*23. The electronic controller claim 19, wherein, to detect a crowd force acting on the work implement of the electrically propelled machine, the electronic controller includes means for at least one of:*

*determining a hydraulic pressure in a hydraulic system that actuates the work implement of the electrically propelled machine;*

*determining that a digging operation of the electrically propelled machine is occurring; or*

*determining that the work implement is in use.*

*24. An electrically-propelled machine, comprising:*

*an electrical power source configured to generate electrical power;*

*an electrical propulsion system including an electric propulsion motor coupled to receive the electrical power from the electrical power source and propel the machine;*

*a hydraulic system including an electrically-powered pump coupled to receive the electrical power from the electrical power source and configured to actuate a work implement of the machine; and*

*an electronic controller in control communication with at least the electric propulsion motor, the electronic controller being configured to:*

*determine that the hydraulic system is experiencing a crowd force condition; and*

*in response to determining that the hydraulic system is experiencing a crowd force condition, limit an output torque of the electric propulsion motor by providing a command to the electric propulsion motor, without controlling the electrical power source to change a power output of the electrical power source in order to limit the output torque of the electric propulsion motor.*

*25. The electrically-propelled machine of claim 24, wherein the command to the electric propulsion motor commands the electric propulsion motor to draw at least one of a reduced current or a reduced voltage of the generated electrical power from the electrical power source.*

*26. The electrically-propelled machine of claim 24, wherein the electronic controller is further configured to:*

*determine whether a crowd force acting on the hydraulic system exceeds a threshold; and*

*determine that the hydraulic system is experiencing a crowd force condition when it is determined that a crowd force acting on the hydraulic system exceeds a threshold.*

*27. The electrically-propelled machine of claim 24, further comprising:*

*an operator input device configured to receive input from an operator of the electrically-propelled machine indicative of a commanded output torque of the electric-propulsion motor, wherein the electronic controller is further configured to:*

*determine whether the operator-commanded output torque exceeds an output torque limit corresponding to the crowd force condition; and*

*limit the output torque of the electric propulsion motor only to the extent that the operator-commanded output torque exceeds the output torque limit.*

*28. The electrically-propelled machine of claim 24, wherein, to determine that the hydraulic system is experiencing a crowd force condition, the electronic controller is further configured to perform at least one of the following:*

*determine that a hydraulic pressure in the hydraulic system exceeds a threshold;*

*determine that a digging operation of the electrically-propelled machine is occurring; or*

*determine that the work implement is in use.*

*29. An electrically-propelled machine comprising:*

*an electrical power source configured to generate electrical power;*

*a DC bus coupled to the electrical power source and configured to store the generated electrical power;*

*an electrical propulsion system including:*

*an electric propulsion motor for propelling the machine; and*

*a first power converter coupled to the DC bus and to the electric propulsion motor, the first power converter providing the stored electrical power from the DC bus to the electric propulsion motor;*

*a hydraulic system including:*

*an electrically-powered hydraulic pump configured to actuate a work implement of the machine;*

*a second power converter coupled to the DC bus and to the electrically-powered hydraulic pump, the second power converter providing the stored electrical power from the DC bus to the electrically-powered hydraulic pump; and*

*an electronic controller in control communication with at least the hydraulic system and the first power converter, the electronic controller being configured to:*

*determine that the hydraulic system is experiencing a crowd force condition;*

*in response to determining that the hydraulic system is experiencing a crowd force condition, limit an output torque of the electric propulsion motor by providing a command to the first power converter, without controlling the electrical power source to change a power output of the electrical power source in order to limit the output torque of the electric propulsion motor.*

*30. The electrically-propelled machine of claim 29, wherein the command to the first power converter commands the first power converter to draw at least one of a reduced current or a reduced voltage of the generated electrical power from the DC bus.*

*31. The electrically-propelled machine of claim 29, wherein the electronic controller is further configured to:*

*determine whether a crowd force acting on the hydraulic system exceeds a threshold; and*

*determine that the hydraulic system is experiencing a crowd force condition when it is determined that a crowd force acting on the hydraulic system exceeds the threshold.*

*32. The electrically-propelled machine of claim 29, further comprising:*

*an operator input device configured to receive input from an operator of the electrically-propelled machine indicative of a commanded output torque of the electric-propulsion motor, wherein the electronic controller is further configured to:*

*determine whether the operator-commanded output torque exceeds an output torque limit corresponding to the crowd force condition; and*

*limit the output torque of the electric propulsion motor only to the extent that the operator-commanded output torque exceeds the output torque limit.*

*33. The electrically-propelled machine of claim 29, wherein, to determine that the hydraulic system is experiencing a crowd force condition, the electronic controller is further configured to perform at least one of the following:*

*determine that a hydraulic pressure in the hydraulic system exceeds a threshold;*

*determine that a digging operation of the electrically-propelled machine is occurring; or*

*determine that the work implement is in use.*

* * * * *